US005687904A

United States Patent [19]

Potter

[11] Patent Number: 5,687,904

[45] Date of Patent: Nov. 18, 1997

[54] ENVELOPE AND A BLANK FOR MAKING AN ENVELOPE

[76] Inventor: Richard Potter, 23410 Los Encinos Way, Woodland Hills, Calif. 91367

[21] Appl. No.: 639,790

[22] Filed: Apr. 29, 1996

[51] Int. Cl.[6] ..... B65D 27/04; B65D 27/06

[52] U.S. Cl. ..... 229/303; 229/68.1; 229/70; 229/75; 229/92.7

[58] Field of Search ..... 229/303, 70, 68.1, 229/92.7, 75

[56] References Cited

U.S. PATENT DOCUMENTS

| | | | |
|---|---|---|---|
| 1,076,357 | 10/1913 | Euwer | 229/92.7 |
| 1,201,419 | 10/1916 | Adams | 229/92.7 |
| 2,112,227 | 3/1938 | Berkowitz | 229/70 |
| 2,166,439 | 7/1939 | Johnson | 229/70 |
| 2,346,419 | 4/1944 | Dunlop | 229/75 |
| 2,558,040 | 1/1951 | Kureger | 229/303 |
| 3,140,800 | 7/1964 | Johnson et al. | 229/70 |
| 3,187,986 | 6/1965 | Simjian | 229/68.1 |

*Primary Examiner*—Stephen P. Garbe

*Attorney, Agent, or Firm*—McAulay Fisher Nissen Goldberg & Kiel, LLP

[57] ABSTRACT

The envelope is constructed with cut outs or openings in the back ply to expose the glue on the folded over tabs secured to the back ply. An overlying panel is secured to the glue via the openings to facilitate processing in automated postal equipment. A second panel is folded under the first panel and is preprinted for use as a merchandise order form. The envelope may be provided with statements and a return envelope which is sized to receive the merchandise order form.

9 Claims, 2 Drawing Sheets

ENVELOPE AND A BLANK FOR MAKING AN ENVELOPE

This invention relates to an envelope and to a blank for making an envelope. More particularly, this invention relates to a billing envelope containing multiple inserts which include a statement and a return envelope.

As described in U.S. Pat. No. 5,467,917, various types of envelopes have been used for billing purposes. In some cases the envelopes have been stuffed with a return envelope so that a recipient may make a bill payment by returning an invoice part in the return envelope. In other cases, the envelopes have been constructed in unique ways to form return mailers.

Billing envelopes used by large billing organizations, such as banks and credit card companies, while being suitable for automated use under postal regulations have not been easily constructed with advertising panels so as to be suitable for automated use under postal regulations.

Accordingly, it is an object of the invention to provide an envelope for return mailing of invoices, order forms and the like which conforms with postal regulations.

It is another object of the invention to provide an envelope which can be provided with integrated panels for ordering merchandise.

It is another object to provide a mailing envelope which has a high impact impression on a recipient.

It is another object of the invention to provide an envelope which can be used by a direct mail advertiser in promotional work.

Briefly, the invention provides an envelope which is constructed in a conventional manner of a front ply to define a face of the envelope, a back ply secured to the front ply in order to form a pocket and glue in order to secure the front and back plies together. Typically, the front ply is provided with a tab at each side which is folded over the front ply to be secured via the glue to the back ply to form an expansible pocket. Alternatively, the back ply can be folded over the front ply without the use of tabs or the back ply may be separately formed from the front ply in which case a third line of glue is required in order to seal the plies together along a transverse lower edge. As is also conventional, a flap extends from the front ply in order to allow for folding of the flap over the back ply to seal the pocket.

In accordance with the invention, a first panel extends from and is disposed over the back ply and is secured to the glue on the tabs on each side of the front ply. To this end, the back ply is provided with at least one opening on each of two longitudinal sides in order to expose the glue on the tabs to the panel. Thus, the panel may be firmly secured directly to the tabs via the glue in order to avoid any unsecured edges which might otherwise lift off and cause a jam during processing in automated equipment such as used in the processing of mail.

In addition, a second panel extends from the first panel and is folded between the first panel and the back ply of the envelope. In order to accommodate the securement of the first panel to the folded over tabs of the envelope, the second panel is of less width than the first panel. That is to say, the second panel is able to fit within the confines of the glue.

In this embodiment, the flap of the envelope is provided with an adhesive to secure the flap in overlying relation to the first panel.

After the envelope is stuffed, for example, with an invoice, bill, Statement of Account and/or return envelope, the envelope can be sealed by folding over the flap and securing the flap to the back of the first panel.

When the envelope is in a sealed condition, the two panels which extend from the back ply are securely held in place by the glue which are exposed through the openings in the back ply while the flap of the envelope is folded over and secured to the panels folded against the back ply.

In one form of use, the flap of the envelope is sealed against the panel at the back of the envelope. The resultant envelope may then be placed into the mails and processed in the usual automated manners. In this respect, the front face of the front ply may be provided with a preprinted address of an addressor as well as with indicia of prepaid postage.

Alternatively, the front ply may be provided with a window over which a transparent patch is secured. This permits information on the contents of the envelope, for example, the address of the addressee printed on an invoice to be exposed.

Upon receipt, the recipient would open the flap in the usual manner to remove and read the contents of the envelope. Next, the recipient may then lift the panels away from the back ply thereby breaking the adhesive connection between the glue on the tabs of the front ply and the first panel. Typically, the glue employs a releasable type of glue which may be readily broken by sliding a finger under the edge of the panels to separate the panels from the back ply of the envelope.

Thereafter, the panels may be folded out and the second panel removed from the first panel, for example along a line of weakening between the two panels. The second panel may be preprinted to define an insert which can be placed into the return envelope for return to the addressor along with a check for payment of an invoice or the like.

The second panel may also serve as an order coupon with blank spaces for receiving the name and address of the recipient/purchaser. As such, the removable panel is sized to fit into a return envelope along with a check or other form of payment for mailing purposes.

These and other objects and advantages of the invention will become more apparent from the following detailed description taken in conjunction with the accompanying drawings wherein.

Figure 1:
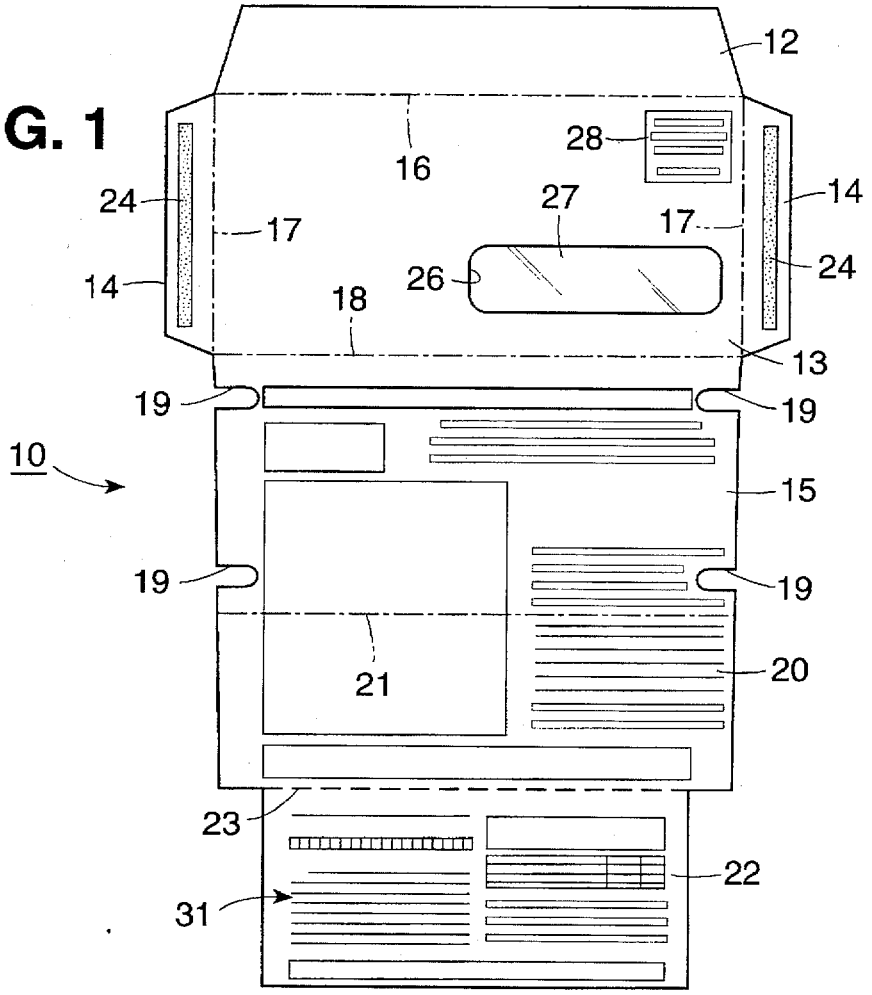
FIG. 1 illustrates a view of the front side of a blank for forming an envelope in accordance with the invention.
Figure 2:
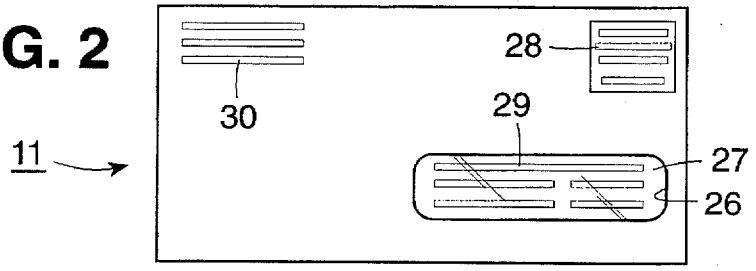
FIG. 2 illustrates a front view of an envelope formed by the blank of FIG. 1 in accordance with the invention.
Figure 3:
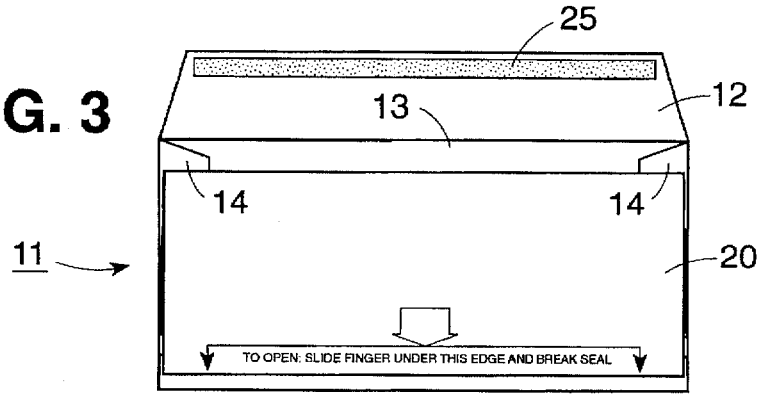
FIG. 3 illustrates a back view of the envelope in FIG. 2.

Referring to FIG. 1, a single one piece blank 10 is formed of various sections in order to be folded into an envelope 11 as illustrated in FIGS. 2 and 3. To this end, the envelope blank 10 includes a first section 12 for forming a flap of the envelope 11, a second section 13 which extends from the first section 12 to form a front ply of the envelope 11, a pair of tabs 14, each of which extends from a respective side of the second section 13 for folding over this section 13 and a third section 15 which extends from the second section 13 to form a back ply of the envelope 11 and for folding over the folded over tabs 14 and the first section 13 in order to define a pocket of the envelope 11. To this point, the blank 10 is of generally conventional structure for forming an envelope.

As illustrated, a fold line 16 is provided between the flap 12 and the front ply 13 to facilitate folding over of the flap 12. Similar fold lines 17, 18 are also provided to facilitate folding over of the tabs 14 and the back ply 15.

In accordance with the invention, the third section (back ply) 15 is provided with at least one opening or slot 19 at each of two longitudinal sides thereof for disposition over a respective folded over tab 14. As illustrated, two slots or openings 19 are formed in each side of the third section 15. In addition, a fourth section 20 extends from the third section 15 for folding over the third section 15 about a fold line 21 and a fifth section 22 extends from the fourth section 20 for folding over the fourth section 20 about a line of weakening 23 such as a row of perforations. As illustrated, this fifth section 22 is of a lesser width than the fourth section 20. The line of weakening 23 disposed between the fourth and fifth sections 20, 22 permits separation of the fifth section 22 from the fourth section 20. The two sections 20, 22 together define an extension of two panels which is to extend from the back ply 15 of the envelope 11 and which can receive advertising or other printed messages.

Figure 4:
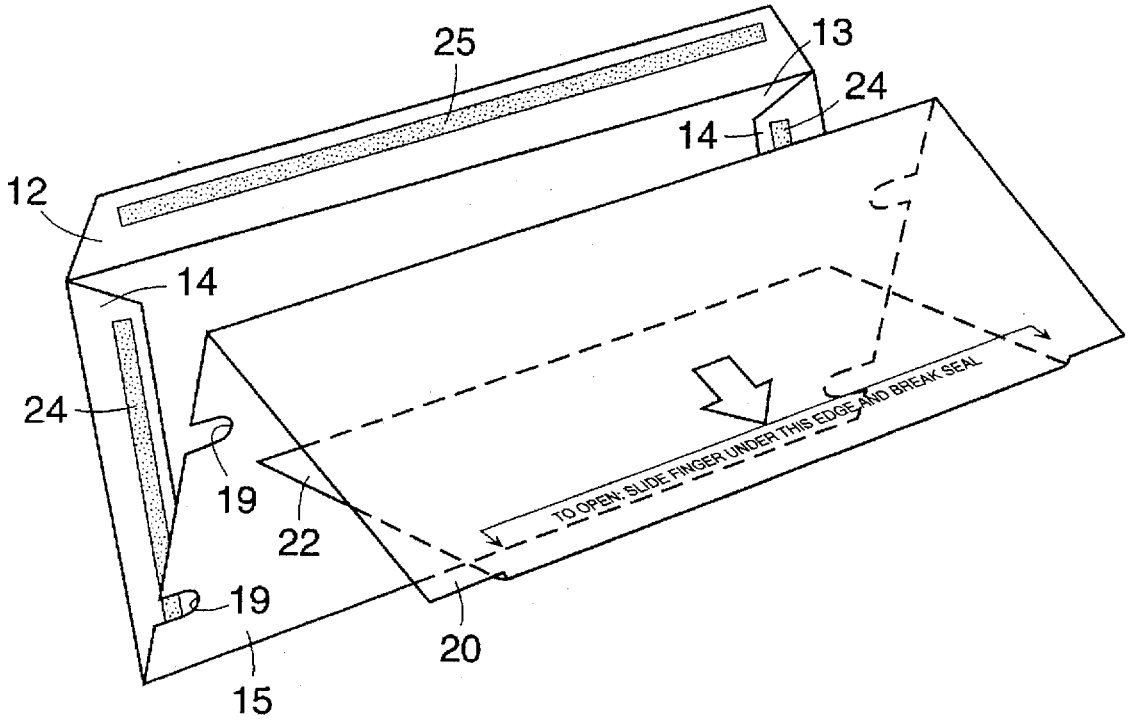
FIG. 4 illustrates a partially folded out view of the envelope to illustrate the construction of the envelope in accordance with the invention.

As shown in FIGS. 1 and 4, each tab 14 is provided with means 24 such as a line of glue, for securing the third section (back ply) 15 to the tabs 14 as well as the fourth section 20 to the tabs 14.

While FIG. 1 illustrates an embodiment employing two openings 19 on each side edge of the back ply 15, there may be only one opening on each side. Further, more than two openings may also be provided to expose the glue areas on the tabs 14 to the first overlying panel 20.

Figure 5:
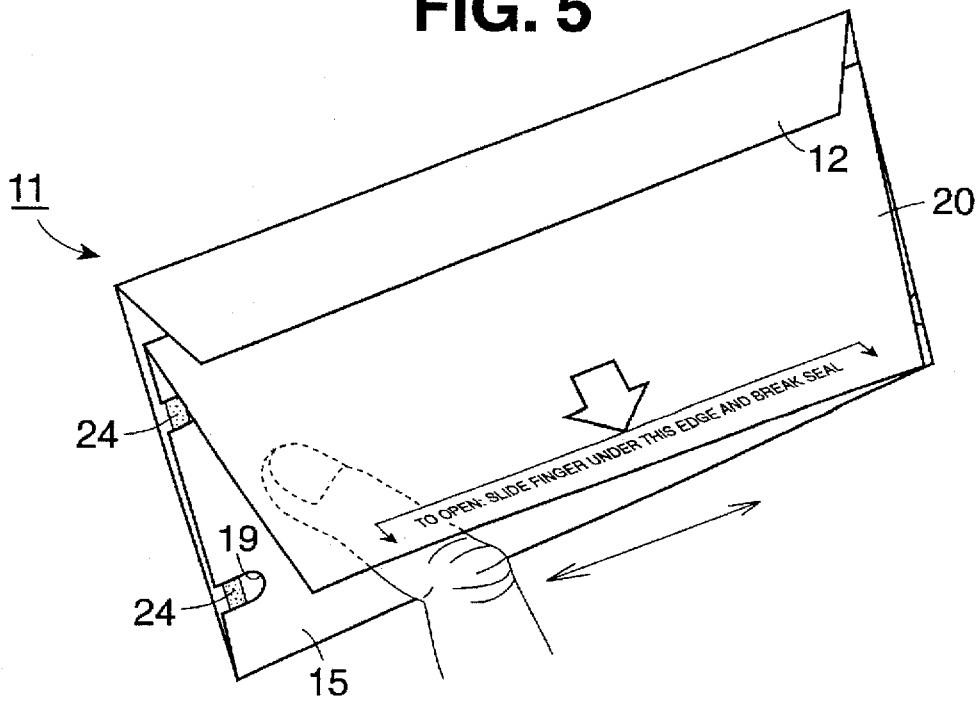
FIG. 5 illustrates a view of the envelope of FIG. 2 during an opening phase.

As illustrated in FIG. 3, the first section 12 of the blank which forms the flap of the envelope 11 is provided with adhesive means 25 for adhesively securing the flap 12 to the fourth section 20 of the blank in overlying relation (see FIG. 5). This means 25 may be in the form of a line of glue, a series of glue dots or the like.

As illustrated in FIG. 1, the first, second and third sections 13, 15, 20 are of equal width.

The second section 13 which is to form the front ply of the envelope 11 may be provided with a window 26 covered over by a transparent patch 27, such as of glassine material, to permit viewing of the contents of the envelope 11 which is to be formed. Preprinted postage indicia 28 may also be printed on the face of this section 13.

Referring to FIG. 4, in order to form the one piece blank 10 into the envelope 11, the tabs 14 are first folded inwardly and the second and third plies 13, 15 are brought together to form the front ply 13 and back ply 15 of the envelope 11. At this time, the glue means 24 on the tabs 14 secures the back ply 15 to the front ply 13 thereby forming an expandable pocket in the envelope 11. Thereafter, the fifth section (panel) 22 of the blank 10 which is of reduced width is folded over the fourth section as indicated in FIG. 4 and the two panels 20, 22 are then folded down onto the back ply 15 of the envelope 11. As shown, since the back ply 15 has openings 19 in the side which expose the glue means 24, the fourth section 20 may be readily adhered to the glue means 24 in overlying relation to the back ply 15 of the envelope 11. At the same time, the fifth ply or panel 22 is securely held in place. Because of the reduced width of this second panel 22, there is no interference of this panel 22 with the securement of the first panel 20 to the glue means 24.

Referring to FIG. 3, after folding the various sections of the one piece blank 10 together, the resultant envelope 11 may then be stuffed with various items. For example, the envelope 11 may be stuffed with a statement of account having an address 29 which appears in the window 26 (see FIG. 2) and a return payment envelope. Thereafter, the flap 12 is folded over and secured to the back of the envelope 11, that is, to the first panel (fourth section) as indicated in FIG. 5. The sealed envelope 11 as indicated in FIG. 2 then resembles a conventional envelope in front view with a return address block 30. The envelope 11 can then be placed in the mails to be forwarded to the address 29 which appears in the window 26.

As indicated in FIG. 1, the panel 22 of reduced width is provided with preprinted indicia 31 which may, for example, be an order form for ordering merchandise.

Referring to FIG. 5, upon receipt of an envelope 11, the recipient would peel back or otherwise sever the flap 12 from the envelope 11 in a conventional manner in order to gain access to the contents of the pocket. After removing the contents, e.g. a statement which is addressed to the recipient and a return envelope, the recipient may also obtain access to the panels 20, 22 secured to the back ply of the envelope. To this end, as indicated in FIG. 5, a finger or the like can be inserted between the folded over panels 20, 22 and the back ply 15 of the envelope 11 to a degree sufficient to break the adhesive connection between the first panel 20 and the tabs 14 of the envelope 11. As indicated, opening instructions can be preprinted on this panel 20 to direct the recipient to open out the panels 20, 22 for viewing. Upon folding out of the two panels 20, 22, the recipient may remove the second panel 22 from the first panel 20 along the line of weakening 23. Where this second panel has been preprinted so as to provide an order form for merchandise, the recipient can then complete the form with the requested information and thereafter place this form, for example, along with a check for payment of the statement of account in the return envelope (not shown). To this end, the panel 22 is of a size so as to readily fit into the return envelope.

The envelope provides several attractive features for a user. First, the envelope provides a conventional pocket for mailing invoices, bills, statements of account and the like to an addressee along with a return envelope. As such, the envelope provides a convenient means of obtaining quick payment of bills and invoices.

At the same time, the envelope may carry advertising or other incentive type messages to induce the recipient to place an order for merchandise. In this respect, the order form (panel 22) is conveniently attached to the envelope so as to be easily removed, filled out and returned in the same envelope as a check for a bill payment.

The envelope may also be used by a direct mail advertiser, for example in the course of promotional work. For example, a printed "mystery message" or sweepstakes number may be printed on the back of the back ply 15 and under the panels 20, 22 for the recipient to discover before opening the main compartment of the envelope.

The back ply 15 of the envelope as well as the first panel 20 provide relatively large surfaces over which advertising messages may be displayed. Likewise, the back of the second panel 22 may also provide additional surface area to provide a message to the recipient.

One of the convenient characteristics of the envelope is that the envelope is particularly suited for automated use under postal regulations.

While a recipient may simply open the envelope and extract the contents of the pockets without folding out the attached panels, attractive messages may be printed on the back of the first panel which are exposed to view so that the recipient is exposed to a message which invites opening and folding out of the panels to gain further information regarding the message being sent.

It is to be noted that the envelope construction is shown as being made from a one piece blank which employs tabs along the side edges of the front ply. However, modifications may be made in such a construction. For example, the use of tabs may be eliminated and the back ply may be secured directly to the front ply via lines of adhesive on the front ply. While such a construction provides for a more limited expansion of the pocket so as to receive inserts, such a structure is also within the scope of the invention.

What is claimed is:

1. An envelope comprising a front ply;

glue on each of two parallel longitudinal sides of said front ply;

a back ply secured to said front ply along a transverse side and said two longitudinal sides to define a pocket therewith, said back ply having at least one opening in each of two longitudinal sides thereof in overlying relation to the glue on each respective said side of said front ply;

a first panel extending from and disposed over said back ply, said panel being secured to said glue on each side of said front panel; and a second panel extending from said first panel and disposed between said first panel and said back ply, said second panel being of less width than said first panel.

2. An envelope as set forth in claim 1 further comprising a flap extending from said front ply and folded over said first panel and means on said flap for adhesively securing said flap to said first panel.

3. An envelope as set forth in claim 2 further comprising a pair of tabs, each tab extending from and folded over said front ply in facing relation to said back ply and having said glue thereon.

4. An envelope comprising a front ply;

a pair of tabs, each tab extending from and folded over a respective side of said front ply;

glue on each said tab;

a back ply secured to said glue on said tabs to define a pocket with said front ply, said back ply having at least one opening in each of two longitudinal sides thereof in overlying relation to a respective glue to expose said respective glue; and an extension integral with said back ply, said extension including at least a first panel extending from said back ply and secured to said glue on said tabs and a second panel extending from said first panel, said second panel being disposed between said back ply and said first panel and being of less width than said first panel.

5. An envelope as set forth in claim 4 further comprising a flap extending from said front ply and folded over said first panel and means on said flap for adhesively securing said flap to said first panel.

6. An envelope as set forth in claim 4 which further comprises a line of weakening between said first panel and said second panel to permit separation of said second panel from said extension.

7. An envelope as set forth in claim 4 wherein said front panel has a window therein for viewing of the contents of said pocket.

8. A blank for forming an envelope comprising a first section for forming a flap of the envelope;

a second section extending from said first section for forming a front ply of the envelope;

a pair of tabs, each said tab extending from a respective side of said second section for folding over said second section;

a third section extending from said second section for forming a back ply of the envelope and for folding over said folded over tabs and said first section to define a pocket, said third section having at least one opening at each side thereof for disposition over a respective folded over tab;

a fourth section extending from said third section for folding over said third section;

a fifth section extending from said fourth section for folding between said fourth section and said third section, said fifth section being of lesser width than said fourth section; and a line of weakening between said fourth section and said fifth section to permit separation of said fifth section from said fourth section.

9. A blank as set forth in claim 8 which further comprises glue on each said tab for securing said third section to said tabs and said fourth section to said tabs and means on said first section for securing said first section to said fourth section in overlying relation.

* * * * *